US005526219A

United States Patent [19]

Stenström et al.

[11] Patent Number: 5,526,219

[45] Date of Patent: Jun. 11, 1996

[54] SURGE ARRESTER ARRANGEMENT

[75] Inventors: Lennart Stenström; Bengt Thors, both of Ludvika, Sweden

[73] Assignee: Asea Brown Boveri AB, Västerås, Sweden

[21] Appl. No.: 256,785

[22] PCT Filed: Jan. 18, 1993

[86] PCT No.: PCT/SE93/00021

§ 371 Date: Aug. 30, 1994

§ 102(c) Date: Aug. 30, 1994

[87] PCT Pub. No.: WO93/17444

PCT Pub. Date: Sep. 2, 1993

[30] Foreign Application Priority Data

Feb. 21, 1992 [SE] Sweden ..... 9200525

[51] Int. Cl.[6] ..... H07H 9/04

[52] U.S. Cl. ..... 361/131; 361/177

[58] Field of Search ..... 361/55, 131, 125, 361/127, 91; 337/30, 31, 34

[56] References Cited

U.S. PATENT DOCUMENTS 4,547,831 10/1985 Hellman et al. ..... 361/127

4,710,847 12/1987 Kortschinski et al. ..... 361/125

*Primary Examiner* A. D. Pellinen

*Assistant Examiner* Sally C. Medley

*Attorney, Agent, or Firm* Watson Cole Stevens Davis

[57] ABSTRACT

The invention relates to a surge arrester arrangement comprising a surge arrester with a number of ZnO blocks arranged between two end electrodes as well as a cut-out device arranged in series with the arrester for automatically disconnecting the arrester in the event of arrester failure. The central part in the cut-out device is a ZnO block (1) with a higher relative energy capability than the blocks in the arrester. In this way, the block in the cut-out device can only break if the arrester connected in series with the device has failed, whereby incorrect tripping of the device is prevented.

7 Claims, 2 Drawing Sheets

8
20
10
7
18
2
4
1
17
3
14
5
6
13
16
19
12
11
15
9

SURGE ARRESTER ARRANGEMENT

FIELD OF THE INVENTION

The present invention relates to a surge arrester arrangement comprising a surge arrester with an elongated insulating casing, in which a number of preferably cylindrical arrester elements of metal oxide varistor material are arranged between two end electrodes, as well as a cut-out device, arranged in series with the arrester, for automatic disconnection of the arrester in the event of arrester failure.

BACKGROUND ART

For a surge arrester placed between phase and ground, an arrester failure in all probability will result in a permanent ground fault. The arrester must then be disconnected or be replaced before the system can be energized again.

For arresters in stations, the relatively short shutdown required for a replacement is acceptable in view of the low risk of an arrester failure. In addition, the risk of operating the system without arrester protection for vital components in the station cannot be taken. Thus, a three-phase surge arrester in a station must be replaced by a new arrester.

The situation is somewhat different for surge arresters placed in the towers of a power line to protect against back flashover caused by lightning, or against switching surges. A failure of such an arrester resulting in a permanent ground fault may entail a lengthy shutdown before the defective arrester has been located and replaced. On the other hand, it is usually acceptable that the arrester is disconnected only. Therefore, if the arrester is provided with a cut-out device which automatically disconnects the arrester in the event of a failure, the operation of the line may continue and any defective arresters be located and replaced at some suitable time.

Surge arresters with cut-out devices are previously known, for example from the U.S. Pat. Nos. 2,305,436 and 4,308,566. However, these prior art cut-out devices have a complicated design, which renders manufacture difficult and increases the risk of malfunction.

The purpose of the present invention is to provide a surge arrester arrangement with a cut-out device which is simple and inexpensive to manufacture and which functions in a reliable manner. This is achieved by a cut-out device with the characteristic features described in claim 1. The cut-out device according to the invention includes a metal oxide block with a larger area than the blocks in the arrester, that is, with a higher relative energy capability. With such a design, the block in the cut-out device can only fail if the arrester connected in series with the device has failed, whereby incorrect tripping of the device is prevented.

BRIEF DESCRIPTION OF THE DRAWING

The invention will be explained in greater detail by describing an embodiment with reference to the accompanying drawing, wherein.

DETAILED DESCRIPTION

Figure 2:
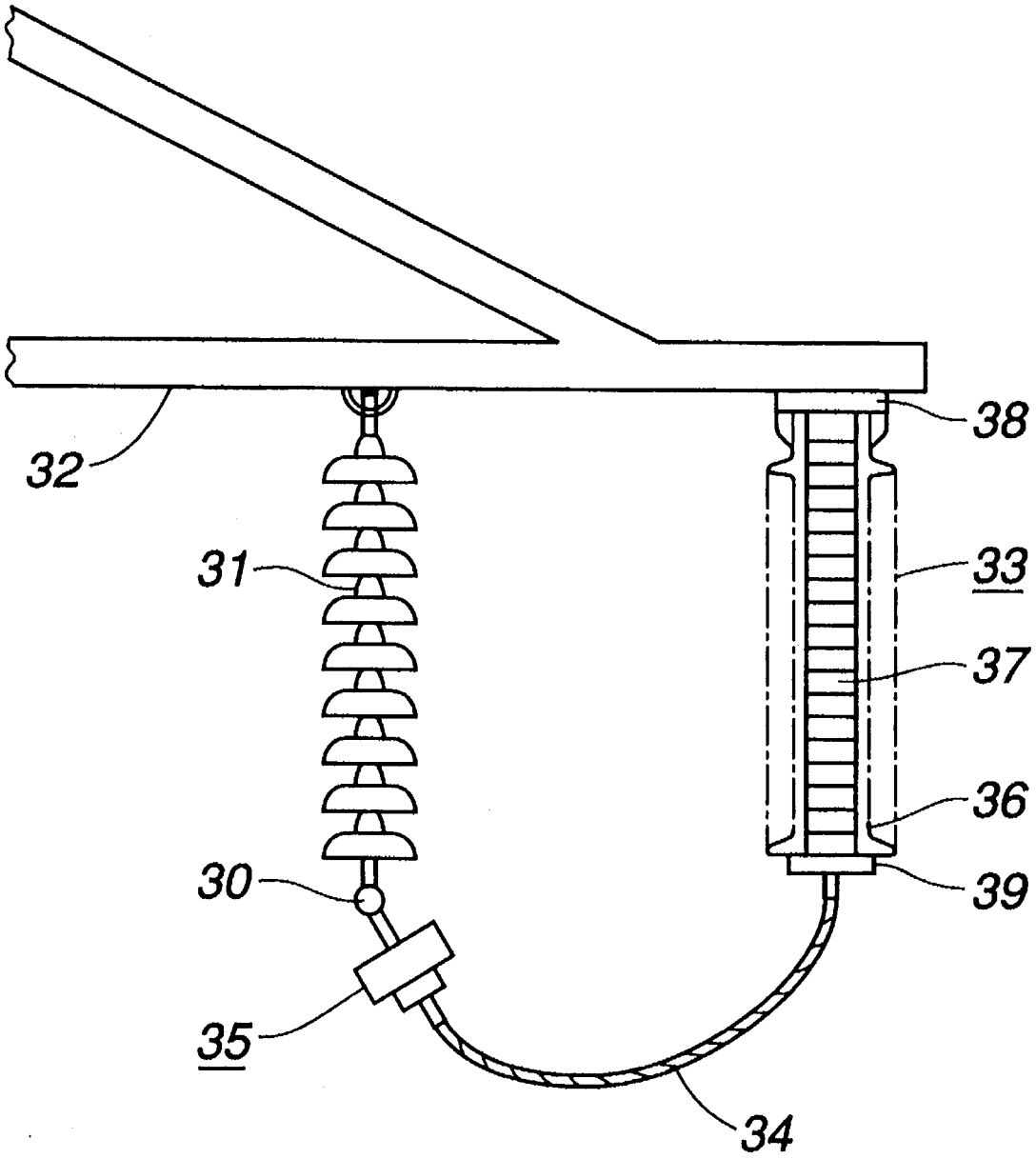
FIG. 2 shows a side view of a surge arrester assembly including the cut-out device.

In the drawings, FIG. 2 shows a power line 30 which, by means of a suspension insulator chain 31, is suspended from a power line tower, of which only an end portion of the horizontal cross beam 32 of the tower is shown in Figure. At the outer end of the cross beam a surge arrester 33 is arranged. The lower end of the surge arrester is connected to the line 30 via a flexible conductor 34 and a cut-out device 35. The surge arrester ×may be of the normally occurring design with an elongated insulating casing 36, in which a number of preferably cylindrical ZnO blocks 37 are arranged between two end electrodes 38 and 39.

Figure 1:
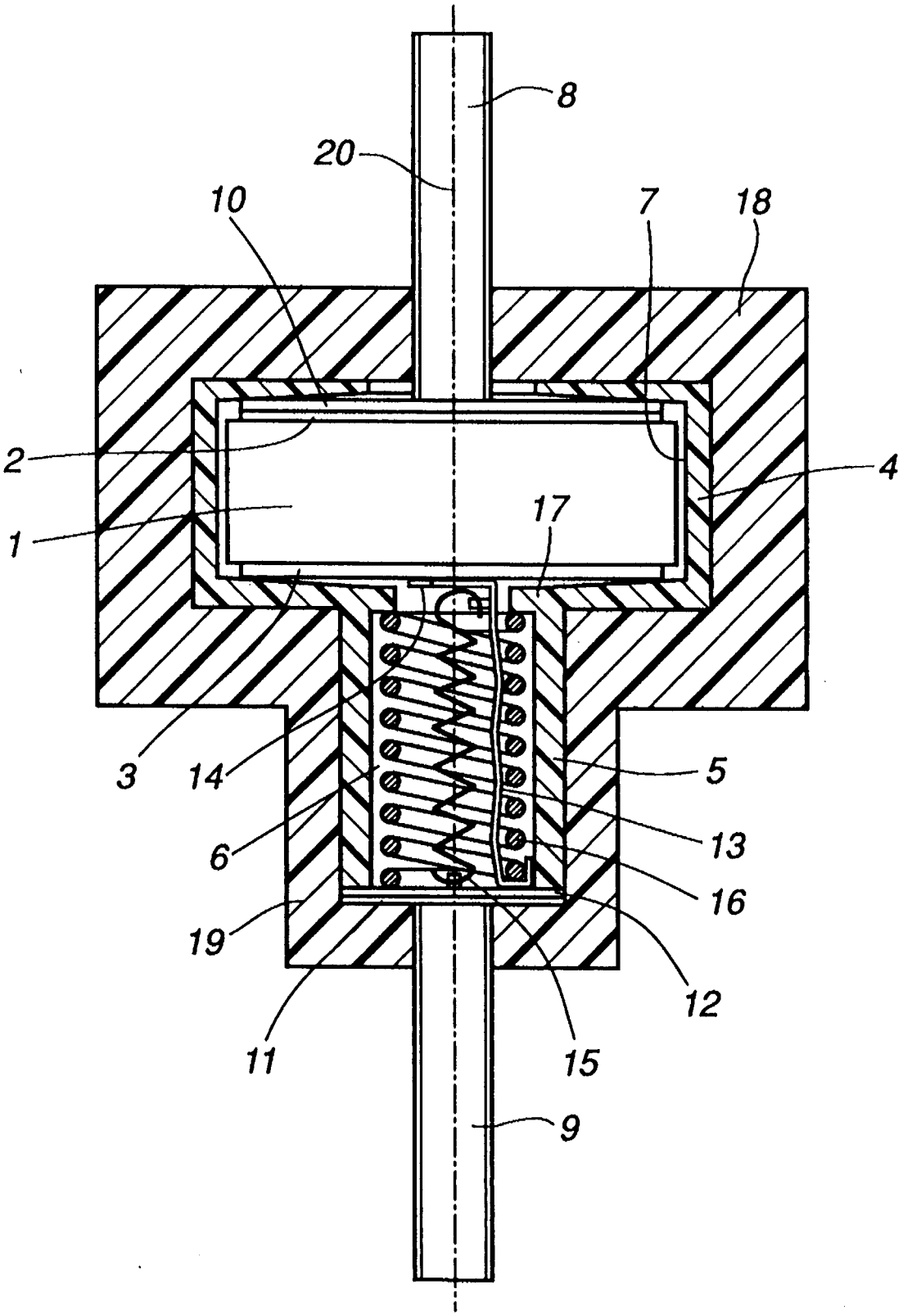
FIG. 1 shows in axial section a cut-out device for a surge arrester designed according to the invention.

Referring now to FIG. 1, the central part of the cut-out device 35 consists of a cylindrical ZnO block 1 with larger diameter than the ZnO blocks 37 in the surge arrester with which the cut-out device is intended to be connected in series. The ZnO block 1 is arranged between two electrode plates 2, 3 of metal, making contact with the end surfaces of the block, and is surrounded by a rotationally symmetrical polymer casing 4, which on the lower side of the block changes into a sleeve-formed part 5 with a smaller diameter than the block. The sleeve-formed part 5 accomodates a chamber 6. The cut-out device is provided with an upper and a lower connection bolt 8 and 9, respectively, which are each fixed to a connection plate 10 and 11, respectively, of metal. The upper connection plate 10 is pressed against the electrode plate 2 which makes contact with the upper end surface of the ZnO block 1. The lower connection plate 11 makes contact with a metal plate 12 which in turn makes contact with the lower end surface of the sleeve-formed part 5 of the polymer casing 4. The metal plate 12 is electrically connected to the electrode plate 3, making contact with the lower end surface of the ZnO block, through a flexible contact sheet 13 arranged in the chamber 6. The connection between the contact sheet 13 and the electrode plate 3 consists of a solder 14. A tension spring 15 arranged in the chamber 6 has its lower end secured to the metal plate 12, whereas the upper end of the spring is fixed to that end of the contact sheet 13 which is soldered to the electrode plate 3.

Further, a compression spring 16 is arranged in the chamber 6, the lower end of the spring resting against the metal plate 12 and the upper end of the spring resting against an annular shoulder 17 in the polymer casing 4.

The polymer casing 4 is divided into two parts along an axial plane 20 and the openings where the ZnO block is mounted taper in wedge form to ensure a contact pressure on the block.

The cut-out device has a rotationally symmetrical outer polymer casing 18, which, for example, may be applied directly to the inner polymer casing 4 by injection moulding or casting. The bottom part 19 of the outer casing, which part surrounds the sleeve-formed part 5 of the inner casing, is, in the example shown, made with a smaller material thickness than the other part of the outer casing.

If the surge arrester which is connected in series with the cut-out device is overloaded and fails, a relatively great current will flow through the ZnO block 1, the temperature of which rapidly increases. If, in that connection, the block is destroyed, an arc is generated which provides a pressure increase in the chamber 6, which causes the outer polymer casing 18 to burst apart, whereby the connection bolt 9 with the plate 11 is mechanically separated from the other part of the device. The compression spring 16 here contributes to rapidly break apart the polymer casing 18. The ZnO block 1 is prevented from falling out through the attachment in the inner casing 4.

If the temperature of the block 1 has become high without the block having failed, which also indicates that the arrester is defective, the solder 14 will loosen (at about 200° C.) and the tension spring 15 pulls the contact plate 13 away from the electrode plate 3, whereby an arc is obtained in the chamber 6 and the polymer casing 18 is burst apart.

In the case of a failure with flashover along the surface of the block 1, the heated gas is passed through connecting channels out into the chamber 6, where the pressure increases until the polymer casing 18 bursts.

The polymer casing 18 is designed with considerably greater mechanical strength in the radial direction than in the axial direction, such that the bottom part 19 in the first place will be burst away if a pressure increase is obtained in the chamber 6. This can be achieved, for example, by fibre reinforcement of the casing in such a way that the reinforcing fibres, at least in the bottom part 19, extend substantially circularly around the axis of the casing.

The invention is not limited to the embodiment shown, but several modifications are feasible within the scope of the claims.

We claim:

1. A surge arrester assembly comprising a surge arrester with an elongated insulating casing, in which a number of preferably cylindrical arrester elements of metal oxide varistor material are mounted between two end electrodes, a cut-out device, connected in series with the surge arrester, for automatic disconnection of the arrester in the event of arrester failure, said cut-out device comprising a triggering means in the form of an arrester element, connected in an electrically insulating casing between two connection members, said attester element of the cut-out device being of the same type as the arrester elements in the arrester but with larger cross-sectional area than the arrester elements.

2. An assembly according to claim 1, wherein said insulating casing delimits a chamber which communicates with a cavity in which the arrester element is connected in such a way that the formation of an arc in the cavity causes a pressure increase in the chamber.

3. An assembly according to claim 2, wherein said arrester element is connected in series with a flexible conductor, mounted in said chamber, via a soldered connection which is capable of being changed by the temperature of the arrester element.

4. An assembly according to claim 3, wherein said flexible conductor is biased by a spring which breaks up the soldered connection if the strength of the connection is reduced because of increased temperature of the arrester element.

5. An assembly according to claim 2 wherein said arrester element of the cut-out device includes end surfaces, with which electrode plates make contact, said insulating easing is divided into two parts along and axial parting plane through the cavity intended for the arrester element, said cavity on both sides of the parting plane tapering in wedge form to achieve contact pressure between said end surfaces and said electrode plates making contact.

6. An assembly according to claim 2, wherein said cut-out device includes an outer casing made of polymer material with considerably greater mechanical strength in the radial direction than the axial direction, for making the outer casing breakable in such a way that the two connection members of the cut-out device are mechanically separated upon pressure increase in said chamber.

7. An assembly according to claim 6, wherein said chamber a pressure spring facilitates the breaking apart of the outer casing at overpressure in the chamber.

* * * * *